US006746391B2

(12) United States Patent
Lurz et al.

(10) Patent No.: US 6,746,391 B2
(45) Date of Patent: Jun. 8, 2004

(54) SWING-OUT-ROTOR LABORATORY CENTRIFUGE WITH NOISE ABATEMENT SYSTEM

(75) Inventors: Werner Lurz, Kaltenkirchen (DE); Roland Lippoldt, Leipzig (DE)

(73) Assignee: Eppendorf AG, Hamburg (DE)

( * ) Notice: Subject to any disclaimer, the term of this patent is extended or adjusted under 35 U.S.C. 154(b) by 0 days.

(21) Appl. No.: 10/289,937

(22) Filed: Nov. 7, 2002

(65) Prior Publication Data

US 2003/0092553 A1 May 15, 2003

(30) Foreign Application Priority Data

Nov. 9, 2001 (DE) ..... 101 55 955

(51) Int. Cl.[7] ..... B04B 5/02
(52) U.S. Cl. ..... 494/20
(58) Field of Search ..... 494/16, 20, 31–34, 494/43, 82, 85; 210/360.1, 380.1

(56) References Cited

U.S. PATENT DOCUMENTS 2,018,837 A * 10/1935 Collatz
3,804,324 A 4/1974 Sinn et al.
3,832,085 A * 8/1974 De
4,820,257 A * 4/1989 Ishimaru
5,518,364 A * 5/1996 Neise et al.
5,916,083 A * 6/1999 Bjorkstrom

FOREIGN PATENT DOCUMENTS

GB 4480 * 5/1887

OTHER PUBLICATIONS

Grenzschicht–Theorie (Boundary Layer Theory) by Dr. Hermann Schlichting, G. Braun publishers, Karlsruhe, Germany, 5th edition, p. 39.

* cited by examiner

*Primary Examiner*—Charles E. Cooley
(74) *Attorney, Agent, or Firm*—Rankin, Hill, Porter & Clark LLP

(57) ABSTRACT

A laboratory centrifuge including at least one bucket receiving sample liquids and mounted in a swing-out manner on a rotationally driven rotor and further including a noise abatement system to reduce the bucket-generated noise. The system has at least one turbulence generator mounted on the external surface of the bucket.

10 Claims, 2 Drawing Sheets

SWING-OUT-ROTOR LABORATORY CENTRIFUGE WITH NOISE ABATEMENT SYSTEM

BACKGROUND OF THE INVENTION

1. Field of the Invention

The invention relates to a laboratory centrifuge and, more specifically, a laboratory centrifuge having a noise abatement system.

2. Description of Related Art

U.S. Pat. No. 3,804,324 is representative of known laboratory centrifuges. In centrifuges of this kind, several buckets are supported radially so they may pivot about tangentially mounted shafts with their centers of gravity outside the shafts.

When the rotor is standing still, the buckets hang down and typically may be loaded with sample liquids, usually in centrifuging vials, for instance at the rate of several vials per bucket, in seats provided for that purpose. As the angular speed rises, the buckets swing outward. The advantage of this design is that the liquid level of the vessels as seen within them remains constant.

The design of this species incurs the drawback of the separate, individual configuration of the buckets, which at higher angular speeds entails strong air turbulence and, hence, strong, interfering noises.

Therefore, the cited known design is fitted with a device, in the form of a closed, sound-absorbing housing, to reduce the bucket-generated noises. This device, however, entails the drawback that the heat generated by the buckets' air turbulence remains trapped in the housing and leads to undesired heating of the sample liquid. The conventional remedy is refrigeration, whereby, however, costs are substantially increased.

SUMMARY OF THE INVENTION

An objective of the present invention is to create a laboratory centrifuge offering a simpler design and lower noise levels.

In the design of the invention, turbulence generators are mounted on the surface of each bucket to interfere with the air flowing by, which heretofore rested in laminar manner against the buckets. Accordingly, as seen in the direction of flow, there is turbulence behind the turbulence generators. As a result there is a significant reduction of the cross-section of the wake behind the buckets. Because of this feature and on account of less interference by the next rotor, there results a significantly reduced noise level.

The invention is based on the assumption to not dampen the noises generated in laboratory centrifuges after they have been generated, but rather to reduce them already as they are being generated, and therefore it exploits the previously overlooked, very old aerodynamic insights that are described in GRENZSCHICHT-THEORIE (Boundary Layer Theory) by Dr. Hermann Schlichting, G Braun publishers, Karlsruhe, Germany, $5^{th}$ edition, on page 39.

Empirical noise reductions up to 6 dB have been attained by use of the present invention Turbulence generators may be mounted on the bucket, as seen in the direction of air flow, relatively far ahead and also relatively far to the rear. However, the turbulence generators must be large in order to act in a sufficiently spoiling manner. In accordance with the present invention, high laminar flow is present at the site of maximum bucket diameter. Even very small turbulence generators may be adequately effective in that zone.

Single compact turbulence generators already may abate noise significantly. Advantageously, however, the turbulence generators are elongated or more than one may be used. In accordance with the present invention, the linearly extending turbulence generator system is situated in zones of approximately equal flows and thereby offers an effect that is constant in length.

Turbulence generators may assume the form of recesses in the bucket surface, for instance, holes or an elongated groove. Advantageously, however, because offering substantially larger effects, the turbulence generator shall be in the form of a salient.

A turbulence generator rising above the surface illustratively may be a protruding pin or a collection of protruding pins or also assume the form of a bonded strip of rough sandpaper. Illustratively, a wire soldered to a substrate or a rising bead or the like may offer outstanding effectiveness. In accordance with another feature of the invention, a simple manufacturing technique accordingly is a cylindrical blank milled-out to attain the desired shape.

BRIEF DESCRIPTION OF THE DRAWINGS

These and further features of the invention will be apparent with reference to the following description and drawings, wherein.

DETAILED DESCRIPTION OF THE PREFERRED EMBODIMENT

Figure 1:
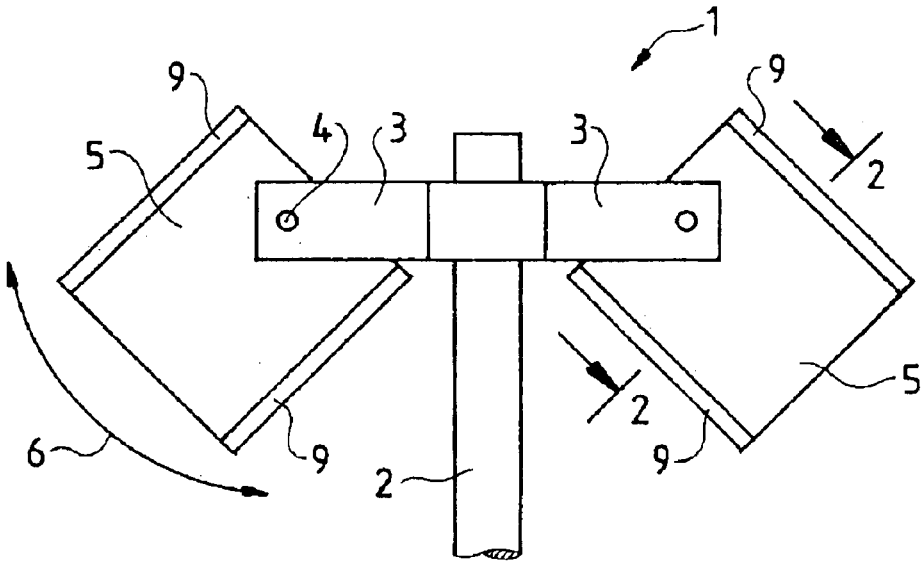
FIG. 1 is a side view of the swing-out rotor of a centrifuge comprising two swing-out buckets.

FIG. 1 is a side view of the rotor 1 of a centrifuge of which the remaining parts are omitted for clarity. The rotor 1 comprises a vertical shaft 2 fitted with radially extending arms 3. The arms, in this embodiment, are shown as two mutually opposite arms with one bucket 5 each pivoting about a tangential pivot 4.

The centers of mass of the buckets 5 are outside the pivots 4. When the rotor 1 is immobile, the buckets 5 will hang down. As the angular speed rises, the buckets 5 will pivot outward in the direction of the arrow 6.

Figure 2:
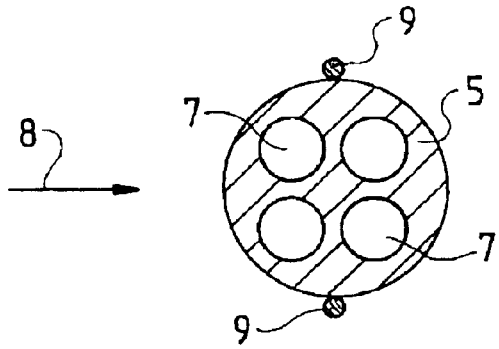
FIG. 2 is a cross-section of a bucket along line 2—2 of FIG. 1.
Figure 3:
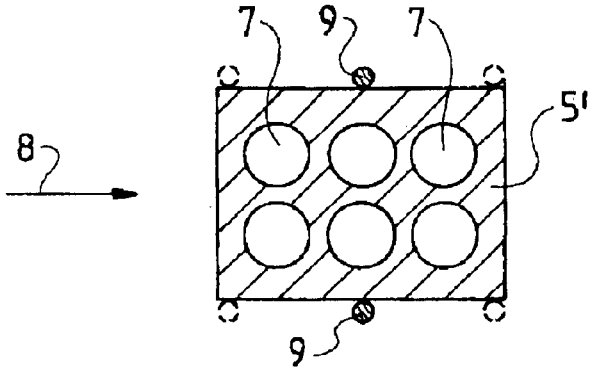
FIG. 3 shows a bucket of another cross-section similarly to the section of FIG. 2.

FIGS. 2 and 3 show two different cross-sections along line 2—2 of FIG. 1. The bucket 5 of FIG. 2 exhibits a circular cross-section and the bucket 5' of FIG. 3 exhibits a rectangular cross-section. It is understood that the buckets each comprise several wells 7 to receive matching centrifuging vials holding sample fluids to be centrifuged.

By means of the arrow 8, FIGS. 2 and 3 show the direction of the air flowing around the shaft 2 and incident on the buckets when the rotor 1 is running. As regards this direction of air flow incidence, the buckets are fitted in the region of their maximum cross-section, at their surface and in a direction transverse to that of the arrow 8, that is transversely to the direction of the air flow, with wires 9 illustratively affixed by soldering that act as turbulence generators.

Figure 4:
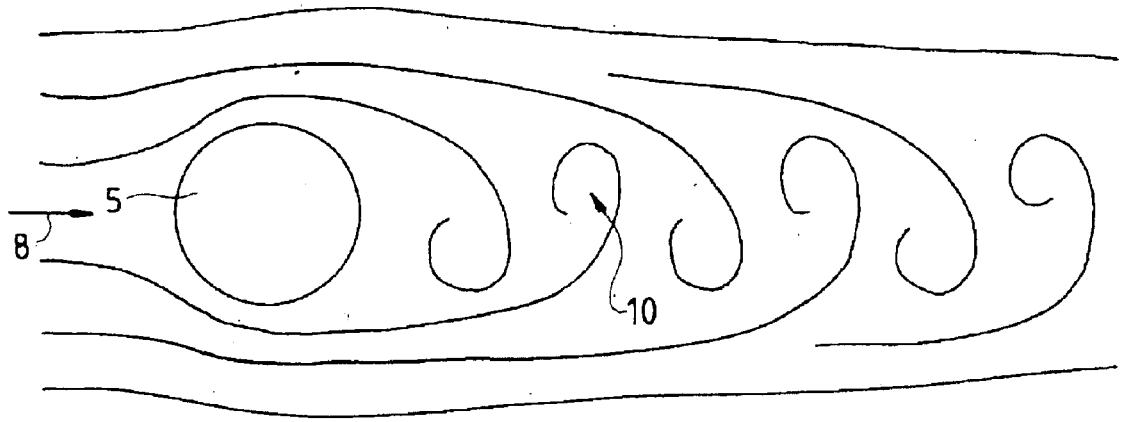
FIG. 4 is a strong simplification of the flow around the bucket of FIG. 2 in the absence of turbulence generator(s)
Figure 5:
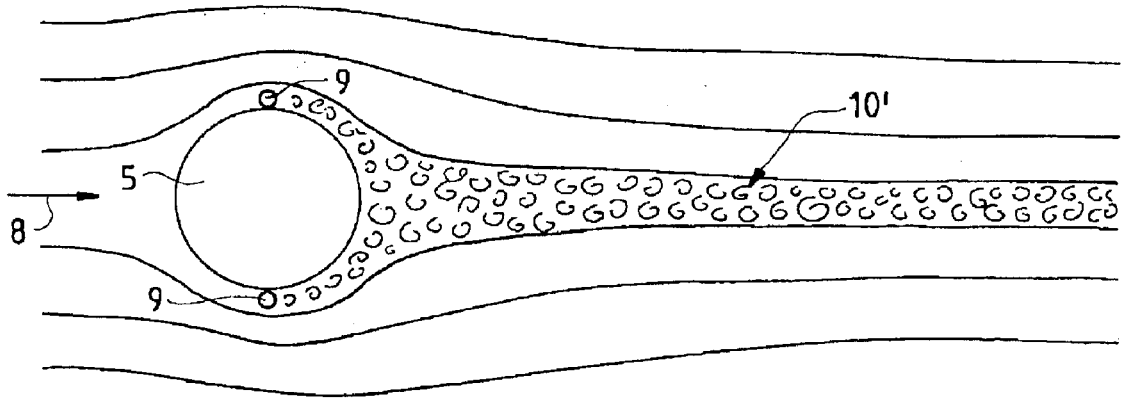
FIG. 5 is a view similar to FIG. 4, but with incident flow in the presence of turbulence generators.

FIGS. 4 and 5 show the aerodynamic effect due to the wires 9 as attained at an appropriate Reynolds number. FIG. 4 shows the air flow around the bucket in the absence of wires. FIG. 5 shows the air flow when wires 9 are present.

As shown in FIG. 4, the bucket 5 is immersed in laminar air flow up to its zone of largest cross-section and even substantially beyond. Following the largest cross-section of the bucket, where its cross-section decreases, that is, when seen in the direction of flow, on the back side of the bucket 5, flow detaches and constitutes the shown turbulence alley 10 forming the wake of which the cross-section approximately corresponds to the maximum cross-section of the bucket 5. The turbulence in the turbulence alley 10 generates substantial noise, in particular also due to spoiling at the subsequent rotors that are omitted from FIG. 4.

As shown by FIG. 5, the wires 9 act as turbulence generators entailing turbulent flow behind the wires 9. A turbulent layer is formed at once against the bucket 5 and is adjacent to the wires 9. The turbulent layer offers the advantage over a laminar flow around the bucket that it follows the surface of the bucket farther out. The resultant turbulence alley 10' therefore exhibits a smaller cross-section than is the case in FIG. 4. The resultant noise is substantially reduced. Noise abatement exceeding 6 dB could be attained in experiments with buckets corresponding to those shown in FIG. 5.

The turbulence generators of the shown embodiment are in the form of apposed wires 9. However the wires 9 may be replaced by other turbulence generators on the bucket, for instance by outwardly bulging beads. Again, grooves fashioned in the bucket surface may exhibit corresponding effects.

In lieu of the linearly running turbulence generators 9 shown in the Figures as being wires or of correspondingly elongated grooves, individual turbulence generators assuming a narrow, point-like geometry may also be used. Such individual turbulence generators may be, for instance, in the form of projecting pins or in the form of holes. The latter geometries may be arrayed staggered behind each other and, optimally, they shall be arrayed linearly along the zone of maximum diameter of the bucket and transversely to the direction of flow.

The spoiler edges generated by the wires 9 in the above embodiment are optimally situated in the zone of largest cross-section. With this zone of largest cross-section extending over a substantial length (FIG. 3), the spoiler edges, as shown in FIG. 3, may be configured at the center of the bucket 5' or also near the front or rear corners, as indicated by dashed lines in FIG. 3.

However, as shown by FIG. 2 with respect to the bucket 5, turbulence generators also may be configured much more forward, that is, toward the arrow 8. In this case, however, they must be made larger to attain a corresponding effect.

Figure 6:
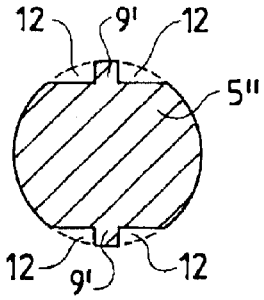
FIG. 6 is a cross-section similar to that of FIG. 2 of a bucket of another embodiment variation.

FIG. 6 shows an embodiment variation over that of FIG. 2 wherein the turbulence generators are in the form of offsets 9' milled out of a cylindrical blank (dashed lines). The design may be implemented in an integral manner using conventional machine tools.

What is claimed is:

1. A laboratory swing-out type centrifuge comprising at least one swing-out bucket (5, 5', 5") receiving sample liquids and supported on a rotationally driven rotor (1) and further comprising a noise abating system (9, 9') to reduce bucket-induced noise, wherein said system consists of at least one turbulence generator (9, 9') mounted on the external surface of the bucket (5, 5'), wherein the turbulence generator is configured as an offset (9') between two milled-out segments (12) that runs parallel to an axis of the bucket (5").

2. The laboratory swing-out type centrifuge as claimed in 1, wherein the turbulence generator (9, 9') is configured transversely to an air flow direction (8) in a region of a largest diameter of the bucket (5, 5').

3. The laboratory swing-out type centrifuge as claimed in claim 1, wherein the turbulence generator (9, 9') or a configuration of several turbulence generators is configured linearly transversely to a direction of air flow.

4. The laboratory swing-out type centrifuge as claimed in claim 1, wherein the turbulence generator (9, 9') is configured to rise from a surface of the bucket (5, 5').

5. A laboratory swing-out type centrifuge comprising at least one bucket (5, 5', 5") adapted to receive at least one sample receptacle and supported on a rotationally driven rotor (1), said bucket further comprising a noise abating system (9, 9') to reduce bucket-induced noise, wherein said system comprises a first and second turbulence generators (9, 9'), said first and second turbulence generators being at opposite sides of the bucket (5, 5') and disposed on an external surface of the bucket, wherein at least one of the first and second turbulence generators comprises a recess formed in the bucket external surface.

6. The laboratory swing-out type centrifuge as claimed in claim 5, wherein the first and second turbulence generators (9, 9') are disposed transversely to an air flow direction (8) in a region of a largest diameter of the bucket (5, 5').

7. The laboratory swing-out type centrifuge as claimed in claim 5, wherein the first and second turbulence generators (9, 9') are configured linearly transversely to a direction of air flow.

8. A laboratory swing-out type centrifuge comprising at least one bucket (5, 5', 5") adapted to receive at least one sample receptacle and supported on a rotationally driven rotor (1), said bucket further comprising a noise abating system (9, 9') to reduce bucket-induced noise, wherein said system comprises a first and second turbulence generators (9, 9'), said first and second turbulence generators being at opposite sides of the bucket (5, 5') and disposed on an external surface of the bucket, wherein at least one of the first and second turbulence generators comprises an offset (9') between two milled-out segments (12) that runs parallel to an axis of the bucket (5").

9. The laboratory swing-out type centrifuge as claimed in claim 8, wherein the first and second turbulence generators (9, 9') are disposed transversely to an air flow direction (8) in a region of a largest diameter of the bucket (5, 5').

10. The laboratory swing-out type centrifuge as claimed in claim 8, wherein the first and second turbulence generators (9, 9') are configured linearly transversely to a direction of air flow.

* * * * *